US008740758B2

(12) United States Patent
Sandvig

(10) Patent No.: US 8,740,758 B2
(45) Date of Patent: Jun. 3, 2014

(54) REHABILITATION DEVICE FOR LEGS

(76) Inventor: Erik Matthew Sandvig, Glen Alen, VA (US)

( * ) Notice: Subject to any disclaimer, the term of this patent is extended or adjusted under 35 U.S.C. 154(b) by 347 days.

(21) Appl. No.: 13/177,197

(22) Filed: Jul. 6, 2011

(65) Prior Publication Data

US 2012/0065030 A1 Mar. 15, 2012

Related U.S. Application Data

(60) Provisional application No. 61/383,133, filed on Sep. 15, 2010.

(51) Int. Cl.
*A63B 22/08* (2006.01)
*A63B 22/10* (2006.01)

(52) U.S. Cl.
USPC ..... 482/79; 482/121; 601/33; 601/34

(58) Field of Classification Search
USPC ..... 482/79, 52, 92, 121, 122, 125, 44, 49, 482/70, 71, 80, 130, 141, 145, 147; 601/24, 601/27, 28, 23, 33–34; D21/685
See application file for complete search history.

(56) References Cited

U.S. PATENT DOCUMENTS

| | | | | | |
|---|---|---|---|---|---|
| 2,720,396 | A * | 10/1955 | Pfaus | 482/130 |
| 3,749,400 | A * | 7/1973 | Stoffel | 482/123 |
| 4,229,001 | A * | 10/1980 | Roman | 482/79 |
| 5,279,530 | A * | 1/1994 | Hess | 482/70 |
| 6,280,366 | B1 * | 8/2001 | Hsieh | 482/130 |
| 6,283,897 | B1 * | 9/2001 | Patton | 482/79 |
| 6,494,816 | B1 * | 12/2002 | Corrado | 482/79 |
| 6,726,642 | B2 * | 4/2004 | Danielsson et al. | 602/5 |
| 6,837,838 | B2 * | 1/2005 | List | 482/147 |
| 7,892,152 | B1 * | 2/2011 | Teng | 482/79 |
| 8,425,437 | B2 * | 4/2013 | Zaborowski | 601/33 |
| 2005/0192158 | A1 * | 9/2005 | Edwards | 482/23 |

* cited by examiner

*Primary Examiner* — Loan H Thanh
*Assistant Examiner* — Nyca T Nguyen

(57) ABSTRACT

A rehabilitation device for legs has a foot piece mounted on a set of track rails, the foot piece is movable through knee extension and flexion, as well as through an elastic band looped around the back. By moving the foot piece, users are able to redevelop and strengthen muscles in the lower leg. Accompanying the foot piece on the track is a slider. The slider measures the distance the user is able to move the foot piece through a plurality of numbered holes in line with the track.

18 Claims, 7 Drawing Sheets

REHABILITATION DEVICE FOR LEGS

The current application claims a priority to the U.S. Provisional Patent application Ser. No. 61/383,133 filed on Sep. 15, 2010.

FIELD OF INVENTION

The present invention relates generally to a device for the rehabilitation of surgically repaired or injured legs. More specifically, the device allows users to rehabilitate their legs through knee flexion and extension while providing a system to closely monitor their progress throughout the rehabilitation process.

BACKGROUND OF THE INVENTION

Traditional methods of rehabilitation for recently healed patients involve targeted exercises for the recently injured body part. During the healing process, patients are refrained from using their injured body part. As a result, the muscles of those body parts weaken due to lack of use and partially lose their functionality. Once the body part has healed, the patients are subject to rehabilitation with targeted exercises to regain functionality of their recently healed body parts. This process requires the patient to use the body part which has been inactive for a period of time. Over time, the body of the patient will begin to recognize the usage of that body part, regain functionality, and build muscle mass. However, with the traditional method for rehabilitation, progress is solely measured through a patient's perception of returned strength and flexibility to the leg. This method is subjective and as a result, patients may end rehabilitation prematurely, before full functionality has been regained. The present invention is able to overcome this shortcoming, by introducing an exercise device that allows patients to quantitatively monitor their own progress during the rehabilitation process.

DETAIL DESCRIPTIONS OF THE INVENTION

All illustrations of the drawings are for the purpose of describing selected versions of the present invention and are not intended to limit the scope of the present invention.

Figure 1:
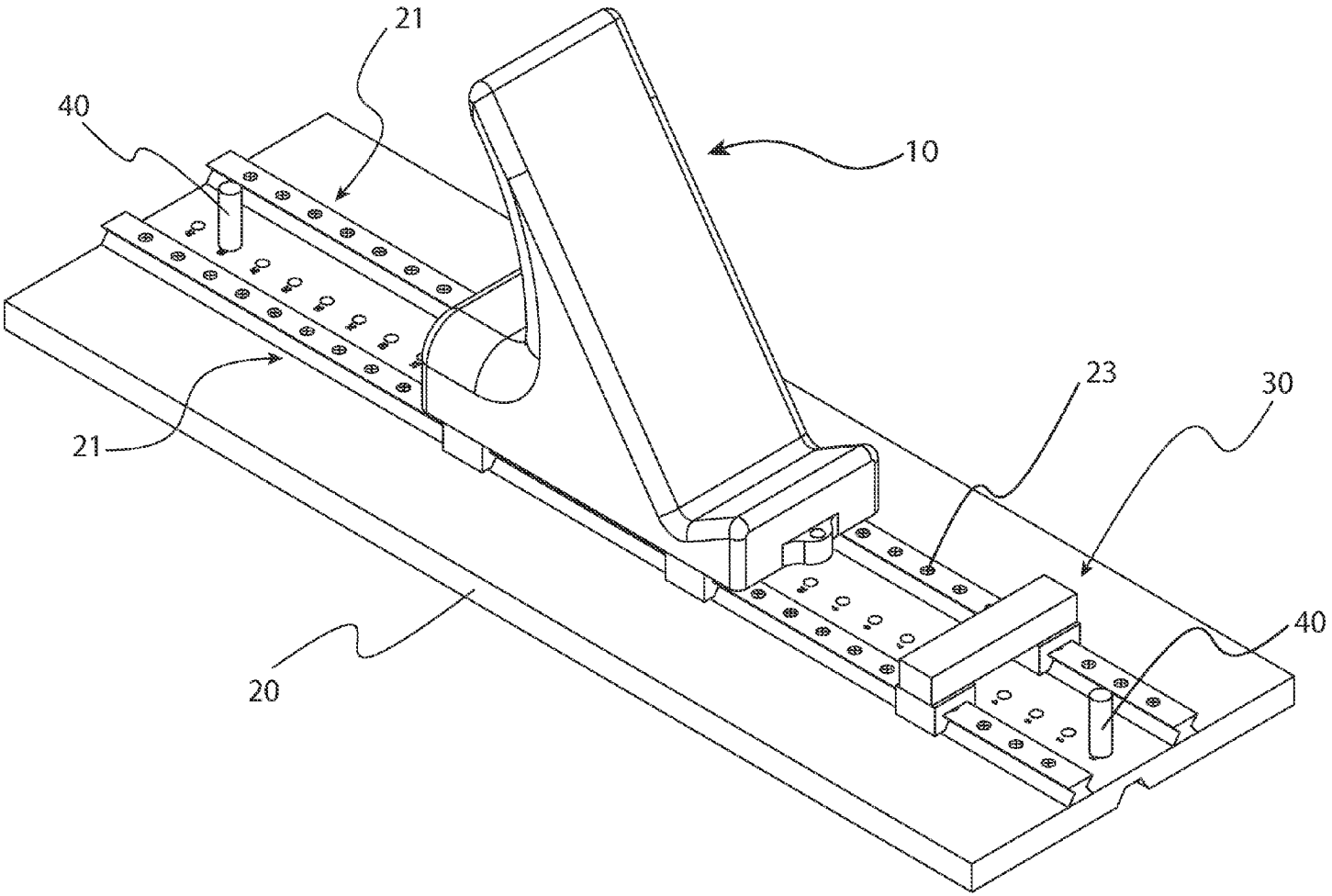
FIG. 1 is an isometric view of the present invention

The present invention is designed to rehabilitate the knee following surgery or injury. This device is designed to complement physical therapy in the restoration of range of motion of the knee and initiate closed-chain strengthening of the lower extremities. This device also provides a method for the user to control and monitor their rehabilitation process. The unique design makes it self-operable, light, and portable, making it ideal for home use. The present invention as seen in FIG. 1 can be divided into several different components including a foot piece 10, a base piece 20, a slider 30, and a plurality of stopper pegs 40.

Figure 2:
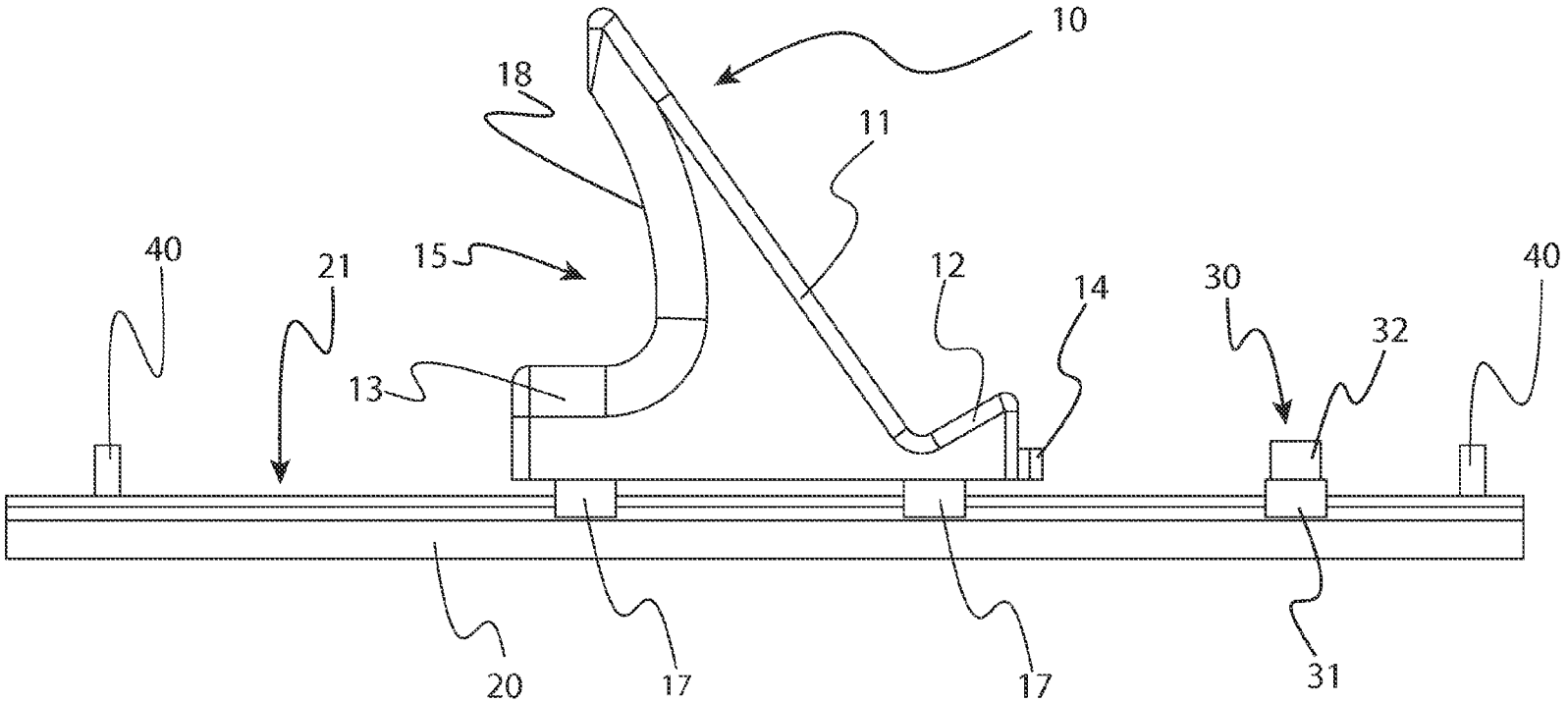
FIG. 2 is a side view of the present invention
Figure 3:
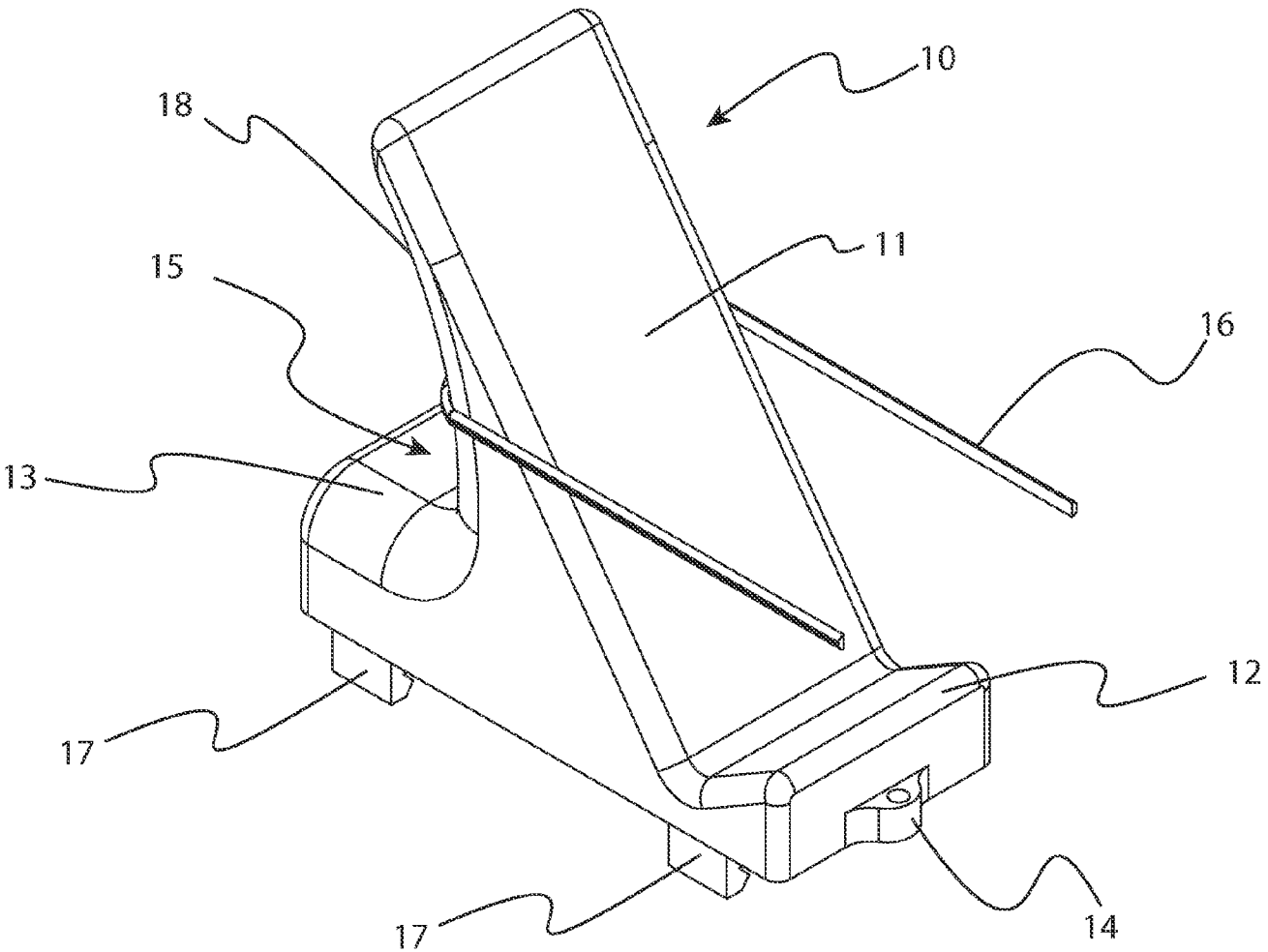
FIG. 3 is an isolated view of the foot piece and elastic band

A core component of the present invention is the foot piece 10, detailed in FIG. 2 and FIG. 3. The device is designed to be used in the supine position with the users' foot resting on the foot piece 10. The foot piece consists of a foot rest 11, a heel support 12, and a support piece 13. The foot rest 11 is angled so that its top section is located above the support piece 13. The front surface of the foot rest 11 makes an approximate 45° angle with the surface of the base piece 20 and is angled away from the user. On the front side of the foot rest 11, the surface is linear, while the upper section of the back side has a concave surface 18 which is partially angled downwards. At the base of the front surface of the foot rest 11 is a heel support 12.

The heel support 12 is a short triangular prism with rounded edges which extends upwards and back towards the user. The foot rest 11 and heel support 12 are oriented so that the sole of the foot rests on the foot rest 11, with the heel and Achilles tendon supported by the heel support 12. The heel support 12 provides a surface for users to apply a force to pull the foot piece 10 back towards the user when bending the knee. The foot rest 11 provides the interface for users to push the foot piece 10 away from the user to extend the knee. The overall height of the heel support 12 is much smaller than the foot rest 11. This reduces the amount the user must exert to move their recently healed leg into the operating position. The rounded edges of the foot rest 11 and heel support 12 also contribute to this accommodation. Rather than requiring the user to lift their foot up over the base of the foot piece 10, the user is able to partially lift their foot to the rounded portion and then slide it into position. The rounded edges also add a degree of comfort to the design. These rounded edges prevent the contact of sensitive body parts, such as the Achilles tendon to sharp or uncomfortable edges. A circular loop 14 has been mounted at the base of the heel support 12. The orientation is such that the hole of the loop 14 is perpendicular to the surface of the base piece 20. The loop 14 provides the user a convenient way to hang the device when not in use, making it ideal for upright storage in closets.

Meanwhile, the support piece 13 is attached to the back of the foot rest 11. The support piece 13 is a rectangular prism with its top corners rounded off, and is approximately one third of the height of the foot rest 11. The support piece 13 is positioned so that its top and bottom surfaces are parallel to the base piece 20, reinforcing the back of the angled foot rest 11. The top surface of the support piece 13 and the over arching concave surface of the foot rest 18 creates a hook 15 for the user to attach an elastic band 16 to the foot piece. The support piece 13 prevents the band 16 from sliding off the bottom of the foot piece 10 and the concave surface 18 prevents the band 16 from being pulled over the top of the foot piece 10. At the hook 15, the user wraps the elastic band 16 around the back of the foot piece 10 with the band 16 extending on both sides back to the user. The user grips the two free ends of the elastic band 16 while a portion of the band 16 remains in contact with the back surface of the foot piece 10, this enables the user to apply tension in the band 16 by pulling on it, resulting in the backwards motion of the foot piece 10. The rounded corners of the support piece 13 and foot rest 11 ensure that no sharp edges slowly compromise the integrity and strength of the elastic band 16.

To operate the device, the user places their foot into the foot piece 10 and pulls on the band 16 to move the foot piece 10 towards the user, resulting in the flexion of the knee. Depending on their current strength and point in the recovery process, the user can bend their knee with solely the use of the bands 16 and upper body, the use of the leg muscles, or a combination of both. The elastic band 16 allows the user to apply a varying amount of force to determine how much assistance should be given to the leg muscles during knee flexion. The orientation of the band 16 also allows the user to apply a resistive force when extending their knee in a leg press motion. This is accomplished by pulling back on the bands 16 as the foot piece 10 is being pushed away from the user. This provides the user the opportunity to participate in the beginning stages of a resistance training and strengthening regimen. The cyclical motion of bending and extending the knee fosters the rehabilitation and restoration of the range of motion of the users' knees and legs. This simplistic mechanism makes the use of the machine very intuitive while maintaining its effectiveness. Thus, users are able to use this device under their own supervision in any environment including the comfort of their own homes.

The elastic band 16 allows the user to apply a varying degree of forces to suit the needs of a specific rehabilitation program. The overall purposes of the elastic band 16 are to provide both assistance in the bending of the knee and to provide a resisting force during the extension of the knee. To accomplish this task, any durable elastic material would suffice. Users can choose materials of varying properties and elasticity to provide higher resistance workouts to suit their needs.

On the bottom surface of the foot piece 10 are four track runners 17. The runners 17 are positioned near the four corners of the foot piece 10. This positioning provides a secure platform for the foot piece 10 to slide back and forth. The track runners 17 are small rectangular prisms with a cavity matching the outline of the track rails 21, allowing it to slide smoothly.

Figure 4:
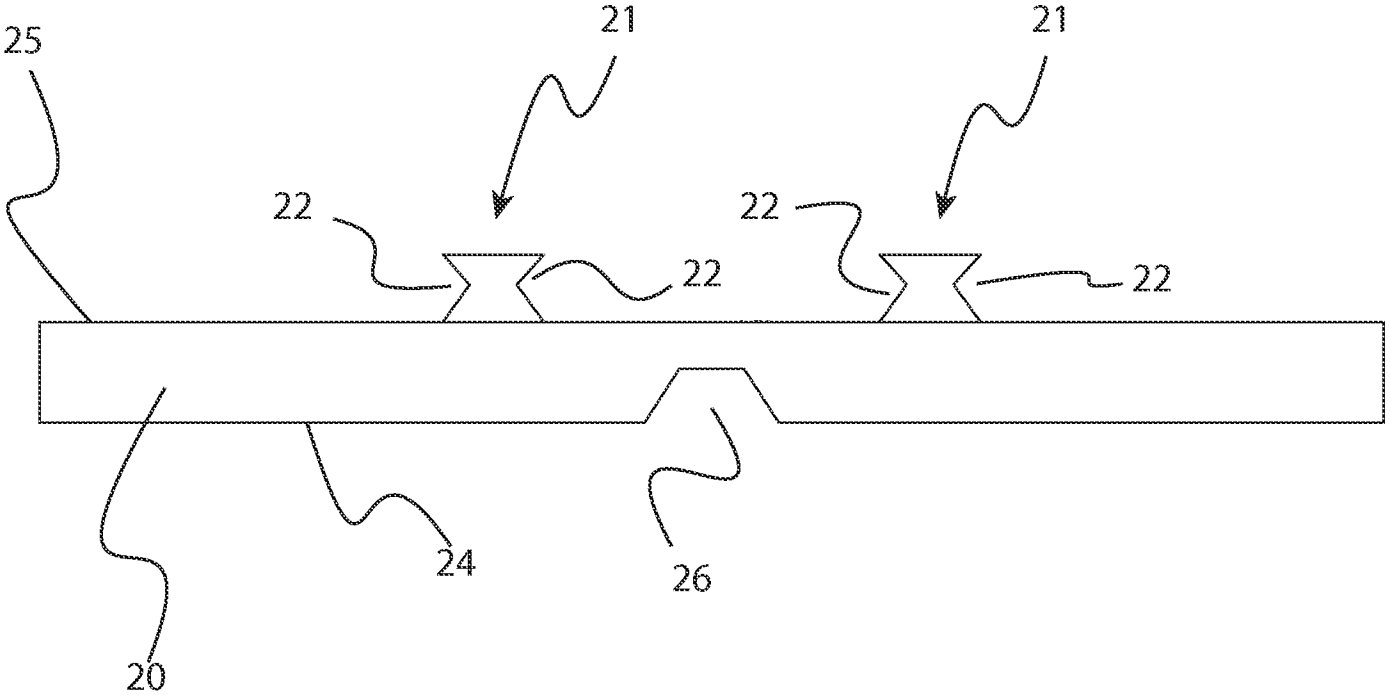
FIG. 4 is a front view of the track rails and base piece
Figure 5:
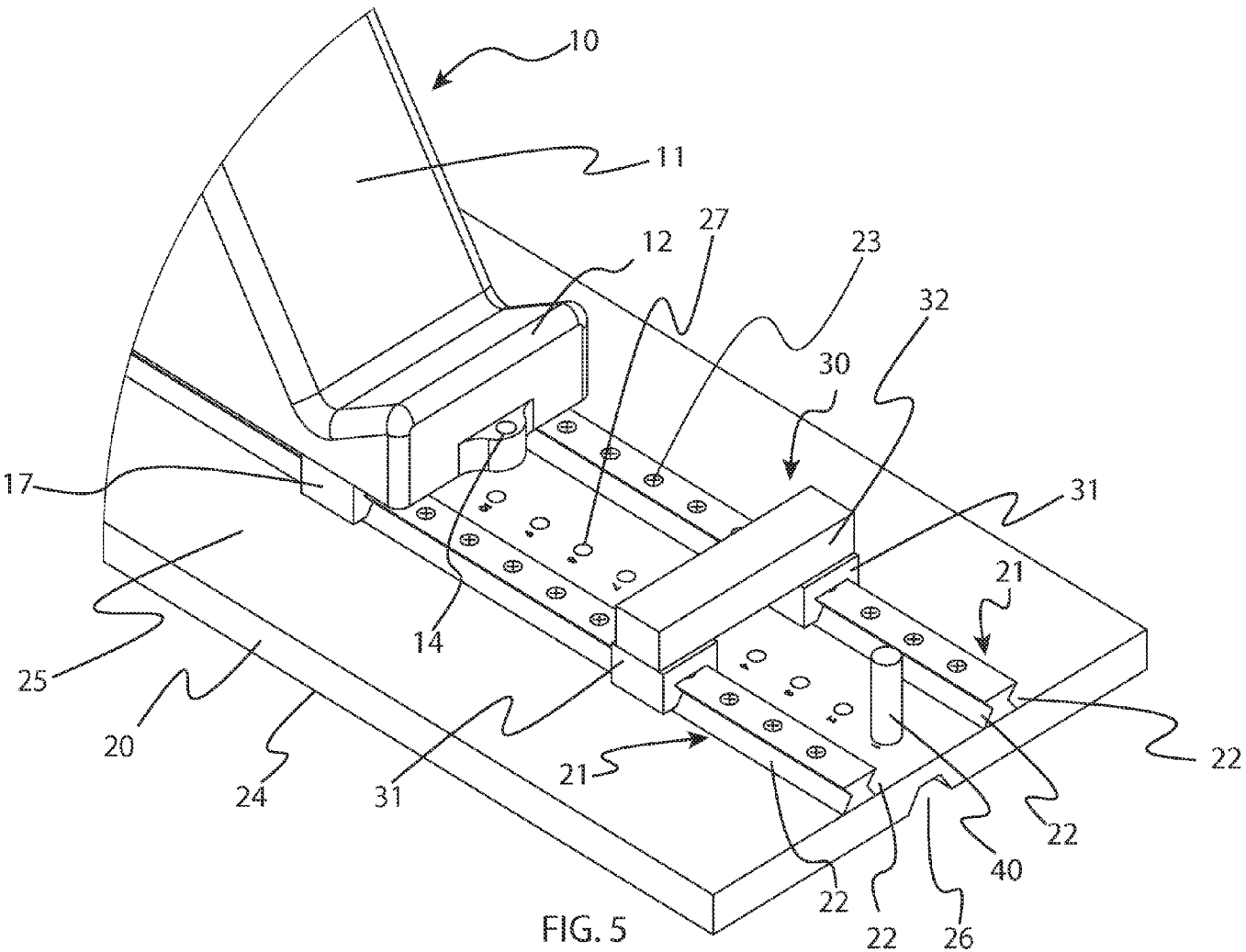
FIG. 5 is a magnified view of the sliding components on the track rails

In reference to FIG. 1, FIG. 4, and FIG. 5, the base piece 20 is a 30 in.×10 in. slab with several different components and features on its surfaces, and serves as the foundation for the device. The relatively small size of the slab makes it lightweight and easily portable, allowing the user to store it away when not in use or take it on travel. However, its small size does not prevent tall users from adequately extending their legs, ensuring that users of any size can utilize the device. On the top surface of the base piece 25 are two track rails 21. The tracks rails 21 are rectangular prisms with triangular cavities on both outside surfaces. These cavities create running grooves 22 along the entire length of the track rails 21. Due to the changes in diameter, the resulting grooves 22 require components to be slid onto the track rails 21 from the ends rather than simply fitting them over the top. This feature limits the vertical motion of the foot piece 10 and slider 30, ensuring that the foot piece 10 and slider 30 are mounted securely on the track rails 21 while not impeding their ability to slide. This prevents the objects from being pushed or pulled off the top, reducing the risk of injury, where any unnecessary or unexpected motion could further damage a weakened knee.

The two track rails 21 create a linear track for the device, and the two rails 21 are parallel to each other, running the entire length of the base piece 20. In the present design, the rails 21 have been secured to the platform with a plurality of screws 23. The track rails 21 could be glued or nailed to the base piece 20 as long as it provides a stable track for the user to move the foot piece 10 and slider 30. However, the screws 23 provide the added advantage of ease of assembly and disassembly. In the future, the track could consist of more than two rails. Two rails are the minimum requirement to provide a stable track. The two track rails 21 reduce the effects of uneven forces applied by the user that may occur on a single railed track.

Figure 6:
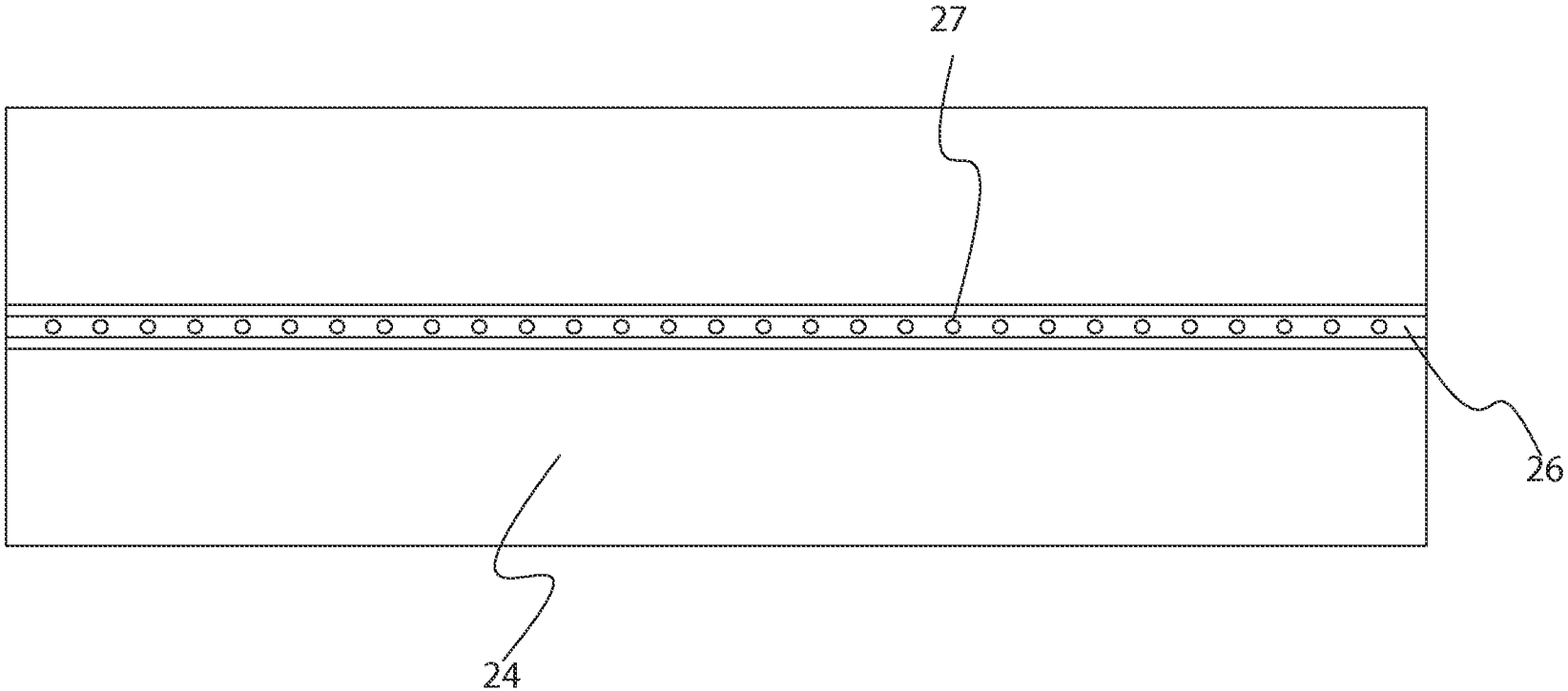
FIG. 6 is a bottom view of the present invention
Figure 7:
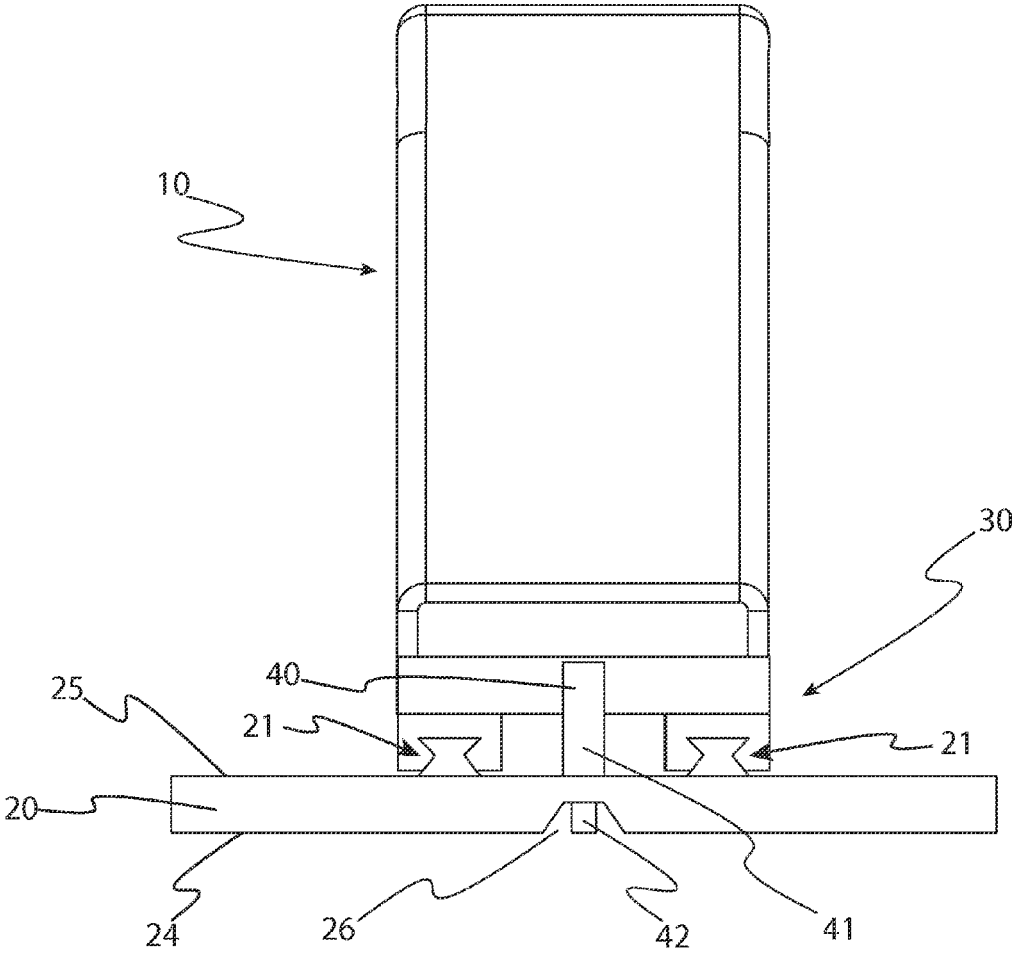
FIG. 7 is a front view of the present invention

Referring jointly to FIG. 1, FIG. 6, and FIG. 7, the bottom surface of the base piece 24 has a bottom cavity 26. The shape of the bottom cavity 26 is that of an isosceles trapezoid. This cavity 26 is approximately half the depth of the base piece 20 and runs the entire length of the base piece 20. It is parallel with the track rails 21 and located in between them. The numbered holes 27 of the device are located along this cavity 26. The holes 27 are circular and start at the top surface of the base piece 25 and finish through to the bottom cavity 26. This leaves an adequate amount of solid material on the base piece 20 to support the stopper pegs 40 while they are being used and under duress.

The bottom surface of the base piece 25 also has a course finish. This provides a frictional force, which is effective on an assortment of surfaces. This frictional force keeps the device in place while it is being used. Without the course finish, there is a high likelihood that the base piece 20 would slip or slide while the device is being used. This scenario would greatly diminish the effectiveness of the workout as all the force applied by the user would slide the entire device rather than just the sliding components, resulting in the user's inability to bend their leg. The bottom surface 24 could be any material which provides an adequate frictional force. Alternative possibilities include a rubber material attached to the bottom surface to provide traction.

In reference to FIG. 1 and FIG. 5, the slider 30 comprises of two track pieces 31 and a bridge piece 32. The two track pieces 31 are of similar shape to the track runners 17 of the foot piece. The track pieces 31 fit onto the rails 21, and the slider 30 is completed by a bridge piece 32 which connects the two track pieces 31. The purpose of the slider 30 is to provide the user a method to monitor their progress when using the invention. The slider 30 is positioned in front of the foot piece 10 on the track rails 21. Exercises are started with the users' leg at full extension, when the user bends their knee and moves the foot piece 10 back; it consequently contacts and moves the slider 30 the distance the user was able to bend their legs. Thus, the slider 30 measures the amount of flexion producible by the knee. Each numbered hole 27 is separated by one inch; the distance the slider 30 moves can be tracked by its initial and final positions with the numbering system 27. This allows the user to not only set goals but also plan and follow a structured rehabilitation regimen. The slider 30 always measures the furthest distance moved by the foot piece 10 because subsequent flexions of shorter length do not contact the slider 30 and the maximum distance is preserved.

In reference to FIG.1, FIG. 5, and FIG. 6, the invention is also equipped with a plurality of stopper pegs 40. Each peg 40 consists of a top 41 and bottom cylinder 42. The bottom cylinder 42 has a smaller diameter than the top cylinder 41. The reduced diameter is such that the stopper pegs 40 can be placed in the numbered holes 27 with the larger top cylinder 42 exposed. With the bottom surface of the top cylinder 41 sitting on the top surface of the base piece 25, the height of the exposed top cylinder 41 is the same height as the slider 30, allowing it to impede the motion of the slider 30. The stopper pegs 40 are durable and easily removable, and can be placed in any of the numbered holes 27.

The stopper pegs 40 act as a safety device. By placing the pegs 40 close to the slider 30 and foot piece 10, the pegs 40 are able to restrict the motion of the foot piece 10. When the user attempts to bend their knee, the slider 30 contacts the stopper pegs 40, preventing the user from moving the foot piece 10, with the system immobilized the user is unable to bend their knee. This prevents users from overworking themselves or performing dangerous flexions with the recovering knee. Stopper pegs 40 can also be placed behind the foot piece 10 to moderate the amount of extension allowable. This feature allows users to follow a set regimen and gradually increase the amount of flexion allowed. The pegs 40 also let a physical therapist set limits on knee flexion or extension. With this system, the user is able to control and monitor the safe execution of the rehabilitation regimen. The stopper pegs 40 also serve to prevent the slider 30 or foot piece 10 from sliding and falling off the track 21. With the stopper pegs 40 preventing horizontal motion on the track rails 21, and the grooves of the track 22 preventing the vertical motion, the motion on the track rails 21 is safely moderated.

The interactions of these components create the fully functional Rehabilitation Device for Legs. While the invention has been described in its preferred embodiment, it is to be understood that a variety of possible modifications can be made to fulfill the purposes of the invention. It is intended that the present invention cover all other embodiments that are within the scope of the appended claims and their equivalents.

What is claimed is:

1. A Rehabilitation Device for Legs comprises,
a base piece;
a foot piece;
a slider;
a plurality of stopper pegs;
the base piece comprises of a plurality of track rails, a top surface, a bottom surface, and a plurality of holes with number labeling;
the foot piece comprises of a foot rest, a support piece, a heel support, a hook, an elastic band, and a plurality of track runners;
the foot piece and the slider are positioned on top of the plurality of track rails;
the plurality of stopper pegs comprises a top cylinder and a bottom cylinder;
the top cylinder being of larger diameter than the bottom cylinder;
the bottom cylinder is capable of being positioned inside each one of the plurality of holes with number labeling;
the top cylinder being exposed above the top surface; and
the top cylinder being the same height as the slider.

2. The Rehabilitation Device for Legs as claimed in claim 1 comprises,
the plurality of track rails comprises of a left groove and a right groove;
the plurality of track rails being positioned on the top surface of the base piece;
the plurality of track rails being parallel to each other; and
the plurality of track rails being a length of the base piece.

3. The Rehabilitation Device for Legs as claimed in claim 2 comprises,
the left groove and the right groove being located on the plurality of track rails; and
the left groove and the right groove being cavities cutting into the plurality of track rails.

4. The Rehabilitation Device for Legs as claimed in claim 2 comprises,
a plurality of track runners and a bridge piece being positioned on top of the plurality of track rails;
the plurality of track runners and the bridge piece being slid into the left groove and the right groove; and
the slider being positioned in front of the foot piece.

5. The Rehabilitation Device for Legs as claimed in claim 1 comprises,
the foot rest being positioned in front of the support piece;
the foot rest being taller than the support piece;
the foot rest being angled above the support piece;
the foot rest being reinforced by the support piece;
the heel support being positioned in front of the foot rest; and
the plurality of track runners being attached underneath the foot piece.

6. The Rehabilitation Device for Legs as claimed in claim 5 comprises,
the hook being positioned behind the foot rest and above the support piece;
the elastic band being wrapped around the foot rest and in the hook.

7. The Rehabilitation Device for Legs as claimed in claim 1 comprises,
the bottom surface comprises of a bottom cavity;
the bottom cavity being parallel to the plurality of track rails;
the bottom cavity being positioned in between the plurality of track rails; and
the bottom surface being coarsely textured.

8. The Rehabilitation Device for Legs as claimed in claim 7 comprises,
the plurality of holes with number labeling being located on the top surface and above the bottom cavity; and
the plurality of holes with number labeling being circular holes.

9. The Rehabilitation Device for Legs as claimed in claim 1 comprises,
the slider comprises of a plurality of track pieces and a bridge piece; and
the plurality of tracks pieces being connected by the bridge piece.

10. A Rehabilitation Device for Legs comprises,
a base piece;
a foot piece;
a slider;
a plurality of stopper pegs;
the base piece comprises of a plurality of track rails, a top surface, a bottom surface, and a plurality of holes with number labeling;
the foot piece comprises of a foot rest, a support piece, a heel support, a hook, an elastic band, and a plurality of track runners;
the foot piece and the slider are positioned on top of the plurality of track rails;
the plurality of track rails comprises of a left groove and a right groove;
the plurality of track rails being positioned on the top surface of the base piece;
the plurality of track rails being parallel to each other;
the plurality of track rails being a length of the base piece;
the foot rest being positioned in front of the support piece;
the foot rest being taller than the support piece;
the foot rest being angled above the support piece;
the foot rest being reinforced by the support piece;
the heel support being positioned in front of the foot rest;
the plurality of track runners being attached underneath the foot piece;
the slider comprises of a plurality of track pieces and a bridge piece;
the plurality of tracks pieces being connected by the bridge piece;
the bottom surface comprises of a bottom cavity;
the bottom cavity being parallel to the plurality of track rails;
the bottom cavity being positioned in between the plurality of track rails; and
the bottom surface being coarsely textured.

11. The Rehabilitation Device for Legs as claimed in claim 10 comprises,
the plurality of holes with number labeling being located on the top surface and above the bottom cavity; and the plurality of holes with number labeling being circular holes.

12. The Rehabilitation Device for Legs as claimed in claim 11 comprises, the plurality of stopper pegs comprises a top cylinder and a bottom cylinder;

the top cylinder being of larger diameter than the bottom cylinder;

the bottom cylinder is capable of being positioned inside each one of the plurality of holes with number labeling;

the top cylinder being exposed above the top surface; and the top cylinder being the same height as the slider.

13. The Rehabilitation Device for Legs as claimed in claim 10 comprises, the left groove and the right groove being located on the plurality of track rails; and the left groove and the right groove being cavities cutting into the plurality of track rails.

14. The Rehabilitation Device for Legs as claimed in claim 10 comprises, the plurality of track runners and the bridge piece being positioned on top of the plurality of track rails;

the plurality of track runners and the bridge piece being slid into the left groove and the right groove; and the slider being position in front of the piece.

15. The Rehabilitation Device for Legs as claimed in claim 10 comprises, the hook being positioned behind the foot rest and above the support piece; and the elastic band being wrapped around the foot rest and in the hook.

16. A Rehabilitation Device for Legs comprises, a base piece;

a foot piece;

a slider;

a plurality of stopper pegs;

the base piece comprises of a plurality of track rails, a top surface, a bottom surface, and a plurality of holes with number labeling;

the foot piece comprises of a foot rest, a support piece, a heel support, a hook, an elastic band, and a plurality of track runners;

the foot piece and the slider are positioned on top of the plurality of track rails;

the plurality of track rails comprises of a left groove and a right groove;

the plurality of track rails being positioned on the top surface of the base piece;

the plurality of track rails being parallel to each other;

the plurality of track rails being a length of the base piece;

the foot rest being positioned in front of the support piece;

the foot rest being taller than the support piece;

the foot rest being angled above the support piece;

the foot rest being reinforced by the support piece;

the heel support being positioned in front of the foot rest;

the plurality of track runners being attached underneath the foot piece;

the slider comprises of a plurality of track pieces and a bridge piece;

the plurality of tracks pieces being connected by the bridge piece;

the bottom surface comprises of a bottom cavity;

the bottom cavity being parallel to the plurality of track rails;

the bottom cavity being positioned in between the plurality of track rails;

the bottom surface being coarsely textured;

the top cylinder being of larger diameter than the bottom cylinder;

the bottom cylinder is capable of being positioned inside each one of the plurality of holes with number labeling;

the top cylinder being exposed above the top surface; and the top cylinder being the same height as the slider.

17. The Rehabilitation Device for Legs as claimed in claim 16 comprises, the left groove and the right groove being located on the plurality of track rails;

the left groove and the right groove being cavities cutting into the plurality of track rails;

the plurality of track runners and the bridge piece being positioned on top of the plurality of track rails;

the plurality of track runners and the bridge piece being slid into the left groove and the right groove; and the slider being positioned in front of the foot piece.

18. The Rehabilitation Device for Legs as claimed in claim 16 comprises, the hook being positioned behind the foot rest and above the support piece;

the elastic band being wrapped around the foot rest and in the hook;

the plurality of holes with number labeling being located on the top surface and above the bottom cavity;

the plurality of holes with number labeling being circular holes; and the plurality of stopper pegs comprises a top cylinder and a bottom cylinder.

* * * * *